US005556261A

United States Patent [19]

Kimura et al.

[11] Patent Number: 5,556,261

[45] Date of Patent: Sep. 17, 1996

[54] PISTON TYPE COMPRESSOR

[75] Inventors: Kazuya Kimura; Shigeyuki Hidaka; Yoshitami Kondo, all of Kariya, Japan

[73] Assignee: Kabushiki Kaisha Toyoda Jidoshokki Seisakusho, Kariya, Japan

[21] Appl. No.: 494,884

[22] Filed: Jun. 26, 1995

[30] Foreign Application Priority Data

Jun. 27, 1994 [JP] Japan ..... 6-145062

[51] Int. Cl.[6] ..... F04B 1/12

[52] U.S. Cl. ..... 417/269; 417/572; 92/71

[58] Field of Search ..... 417/269, 572; 92/71

[56] References Cited

U.S. PATENT DOCUMENTS 4,135,862 1/1979 Degawa ..... 417/269

5,232,349 8/1993 Kimura et al. .

*Primary Examiner*—Charles G. Freay

*Attorney, Agent, or Firm*—Brooks Haidt Haffner & Delahunty

[57] ABSTRACT

A piston type compressor compresses gas with a plurality of pistons reciprocated in a casing in accordance with the rotation of a drive shaft supported in the casing. The compressor comprises a plurality of casing components disposed along an axis of the drive shaft and mated with one another for forming the casing. A mechanism suppresses bending moment generated in one of the casing components when the casing components are fastened along a direction parallel to the axis of the drive shaft.

24 Claims, 10 Drawing Sheets

PISTON TYPE COMPRESSOR

BACKGROUND OF THE INVENTION

1. Field of the Invention

The present invention relates to a piston type compressor for use in, for example, an air conditioning system for a vehicle, and, more particularly, to a coupling structure for a cylinder block, a front housing and a rear housing.

2. Description of the Related Art

Generally, piston type compressors for use in a vehicular air conditioning system or a freezer are classified into a double-headed piston type and a single-headed piston type. The double-headed piston type compressor has a front housing connected to the front side of a cylinder block having a plurality of cylinder bores and a rear housing connected to the rear side thereof. As a drive shaft supported on the cylinder block rotates, the individual double-headed pistons reciprocate in the associated cylinder bores via a swash plate. Consequently, suction, compression and discharge of gas occurs in pairs of compression chambers located between the front and rear head portion of each double-headed piston and the associated front and rear housings.

The single-headed piston type compressor has a front housing connected to the front end surface of a cylinder block having a plurality of cylinder bores and a rear housing connected to the rear end surface thereof. The cylinder block and the front and rear housings are securely fastened with bolts. A drive shaft is supported on the front housing and the cylinder block. As the drive shaft rotates, the individual pistons reciprocate in the associated cylinder bores via a swash plate. As a result, gas suction, compression and discharge are executed in compression chambers located between the head portion of each piston and the rear housing.

In the single-headed piston type compressor, as shown in FIG. 12, a front housing 72 is connected to the front end surface of a cylinder block 71, and a rear housing 73 is connected to the rear end surface. Those components are securely fastened with through bolts 74, which penetrate through insertion holes 72*a* of the front housing 72, a crank chamber 75 and insertion holes 71*a* of the cylinder block 71 to engage the rear housing 73. Formed in the cylinder block 71 are a plurality of cylinder bores 71*b* for accommodating a plurality of single-headed pistons and a valve chamber 71*c* for accommodating a rotary valve for drawing in a refrigerant gas as shown in FIG. 13.

Because of the configuration of the housing and the through bolts 74 in this conventional compressor, the aluminum alloy cylinder block 71 flexes slightly and deforms resiliently due to the bending moment produced by the compressive force of the through bolts 74. As shown in FIG. 14, a mating surface between the cylinder block 71 and the front housing 72 forms a vertical surface 76 perpendicular to the center axis O of each through bolt 74. Therefore, fastening force $f_1$ parallel to the center axis O acts on the front end surface of the cylinder block 71 from the front housing 72. Fastening force $f_2$ acts on the rear end surface of the cylinder block 71 along the axis O from the rear housing 73.

Thus, the bending moment M acts around the center Po of a straight line H connecting the point of application P1 of the force $f_1$ on the vertical surface 76 and the point of application P2 of the force $f_2$ on the rear end surface of the cylinder block 71. This moment M is obtained by the following approximation equations:

$$fD_2=f_2D_1$$

$$f=(D_1f_2)/D_2 \quad (1)$$

$$M=2f(D_2/2)=fD_2 \quad (2)$$

where $D_1$ is the distance between both points of application P1 and P2 in the radial direction, $D_2$ is the axial length of the cylinder block 71, and f is the radial component of the forces at the points of application P1 and P2.

The moment M obtained by the equations (1) and (2) acting on the cylinder block 71 causes slight resilient deformation of the shape of the cylinder block 71 as indicated with exaggeration by a two-dot chain line in FIG. 13. Over a period of time, such repeated resilient deformation can deform the cylinder bores 71*b*, which would then interfere with the smooth reciprocation of the pistons. When the valve chamber 71*c* for the rotary valve is formed as shown in FIG. 13, the thickness of the wall between each cylinder bore 71*b* and the valve chamber 71*c* is comparatively thinner and the rigidity of the wall is lower. Therefore, the cylinder bores 71*b* flex more easily during compressor operation. Ultimately, the inner wall of the valve chamber 71*c* may wear in the vicinity of the outer surface of the rotary valve, which would increase the overall frictional resistance as the rotary valve rotates. This tends to interfere with the smooth rotation of the rotary valve. If the through bolts 74 are provided in the cylinder block 71 and the front housing 72 outside the crank chamber 75 to permit the fastening forces $f_1$ and $f_2$ to act on the axial line O of each through bolt 74, no bending moment to deform the cylinder block 71 is produced. In this case, however, the outside diameter of the housing must be made larger. Such a compressor costs more and takes up more valuable space in the engine compartment.

SUMMARY OF THE INVENTION

Accordingly, it is an objective of the present invention to provide a piston type compressor which can properly fit pistons in cylinder bores under the forces fastening through bolts.

According to the present invention, a piston type compressor sucks and compresses gas by a plurality of pistons reciprocated in a casing in accordance with the rotation of a drive shaft supported in the casing. The compressor comprises a plurality of casing components disposed along an axis of the drive shaft and mated with one another for forming the casing. A configuration of the mating juncture suppresses bending moment generated in one of the casing components when the casing components are tightened along a direction parallel to the axis of the drive shaft.

BRIEF DESCRIPTION OF THE DRAWING

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A single-headed piston type compressor of a rocking swash plate type according to a first embodiment of the present invention will now be described referring to FIGS. 1 through 5.

Figure 3:
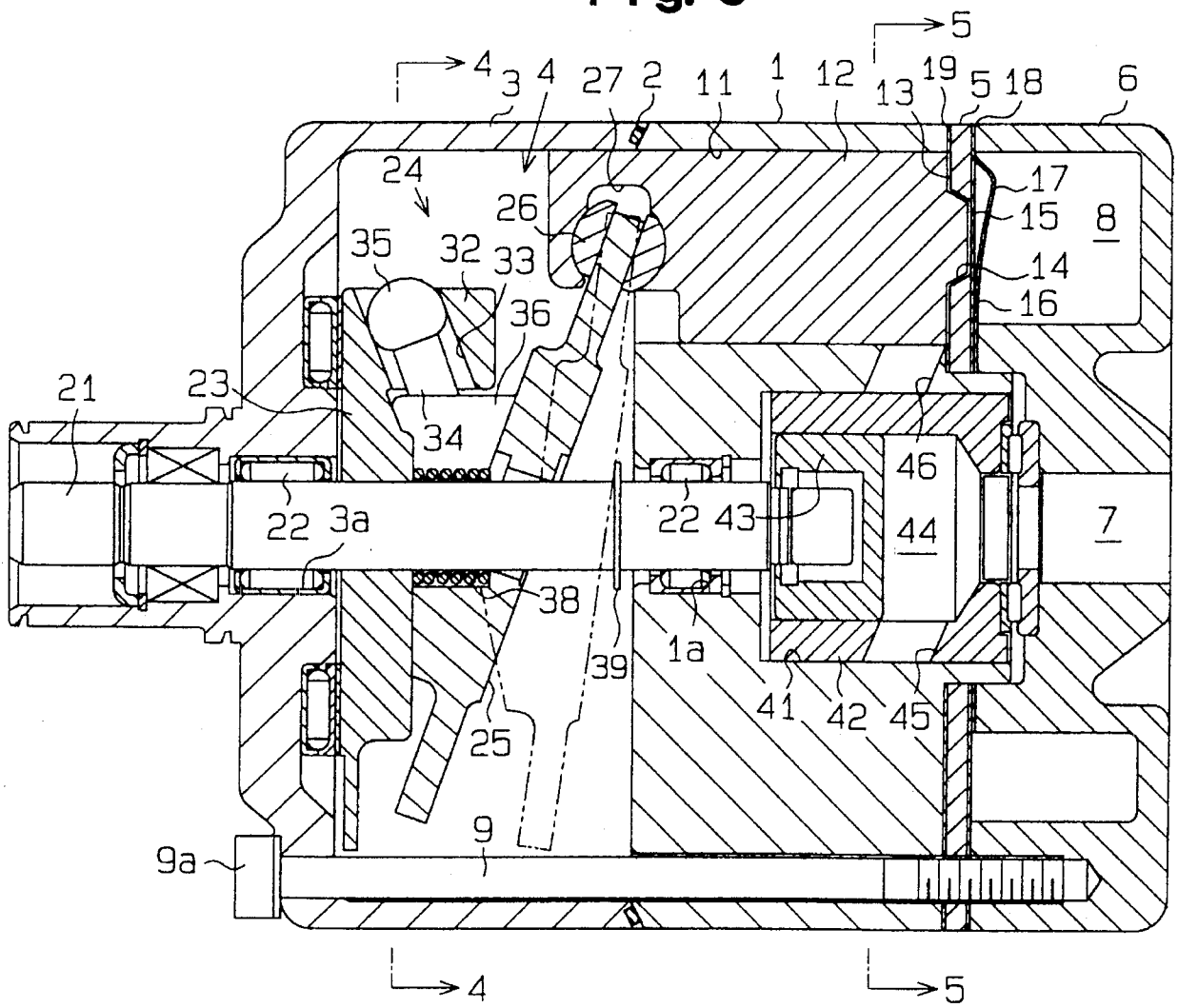
FIG. 3 is a cross-sectional side elevation view showing the overall compressor of the first embodiment.
Figure 4:
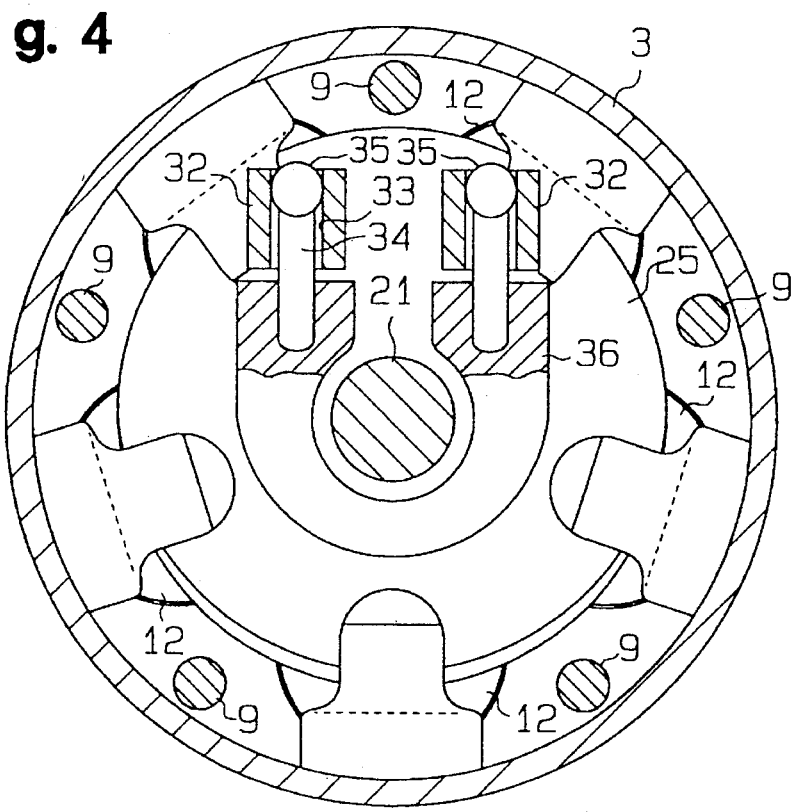
FIG. 4 is a cross-sectional view along the line 4—4 in FIG. 3.
Figure 5:
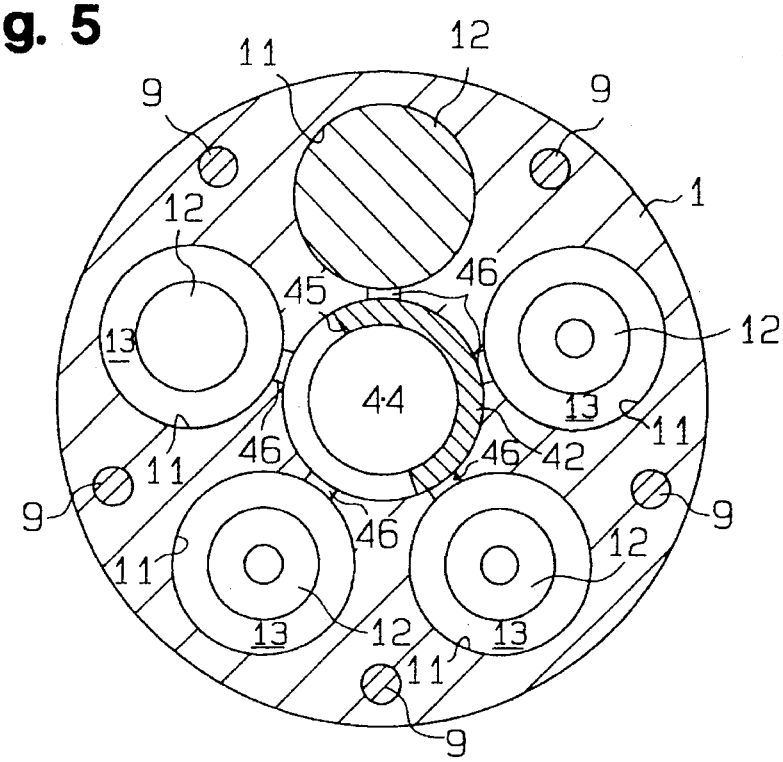
FIG. 5 is a cross-sectional view along the line 5—5 in FIG. 3.

The compressor shown in FIG. 3 has a cylinder block 1 of an aluminum alloy. A front housing 3 of an aluminum alloy is connected to the front end surface of the cylinder block 1 via a seal ring 2. This seal ring 2 is inserted in a groove formed in the mating surface of the front housing 3. A crank chamber 4 is formed inside the cylinder block 1. A rear housing 6 of an aluminum alloy is connected to the rear end surface of the cylinder block 1 via a valve plate 5. A suction chamber 7 and a discharge chamber 8 are formed and partitioned in the rear housing 6. The cylinder block 1 and both housings 3 and 6 are securely fastened together by a plurality of through bolts 9. The cylinder block 1 and the front and rear housings 3 and 6 constitute the casing of the compressor.

A plurality of cylinder bores 11 are formed in a peripheral section of the cylinder block 1, with single-headed pistons 12 accommodated in the respective cylinder bores 11 in a reciprocal manner. A compression chamber 13 formed in each cylinder bore 11, between each piston 12 and the valve plate 5, communicates with the discharge chamber 8 via an associated discharge port 14. A valve plate 16 and a retainer plate 18 are located between the valve plate 5 and the rear housing 6. The valve plate 16 has discharge valves 15 associated with the individual discharge ports 14, and the retainer plate 18 has a retainer 17 for restricting the degree of opening of each discharge valve 15. The retainer plate 18 also serves as a gasket. A gasket 19, different from the retainer plate 18, is located between the cylinder block 1 and the valve plate 5.

A drive shaft 21 is rotatably supported with a pair of radial bearings 22 in axial holes 1*a* and 3*a* centrally formed in the cylinder block 1 and the front housing 3. A drive plate 23 is fixed on the drive shaft 21. A swash plate 25 is supported with a hinge mechanism 24 on the drive plate 23 such that it may tilt in the forward and backward directions. Shoes 26 are attached to the outer surface of the swash plate 25, and a recess 27 is formed in the proximal end of each piston 12. The shoes 26 engage with the recesses 27, and thus the swash plate 25 is functionally coupled to the individual pistons 12.

The hinge mechanism 24 will now be described. A pair of support arms 32 are formed integrally with the drive plate 23, with a guide hole 33 formed in each arm 32. A ball 35, formed at the top end of a guide pin 34, is slidably fitted in each guide hole 33. The lower portion of each guide pin 34 is fixed to an associated bracket 36 integrated with the back of the swash plate 25. A coil spring 38 is located between the drive plate 23 and the swash plate 25. The spring 38 always urges the swash plate 25 in the direction of its minimum inclination. Supported on the drive shaft 21 is a stopper 39 for holding the swash plate 25 at its position of minimum inclination.

Formed in the cylinder block 1 is a valve chamber 41 in which a rotary valve 42 is retained. The rotary valve 42 is coupled with a coupling 43 to the drive shaft 21 in a synchronously rotatable manner. A suction passage 44 which always communicates with the suction chamber 7 is formed in the rotary valve 42. The suction passage 44 has an outlet 45 open to the outer surface of the rotary valve 42. Formed in the cylinder block 1 is a communication hole 46, which communicates with the outlet 45 of the suction passage 44 during in the suction stroke of the associated piston 12.

The essential portions of this invention will now be described in detail.

Figure 2:
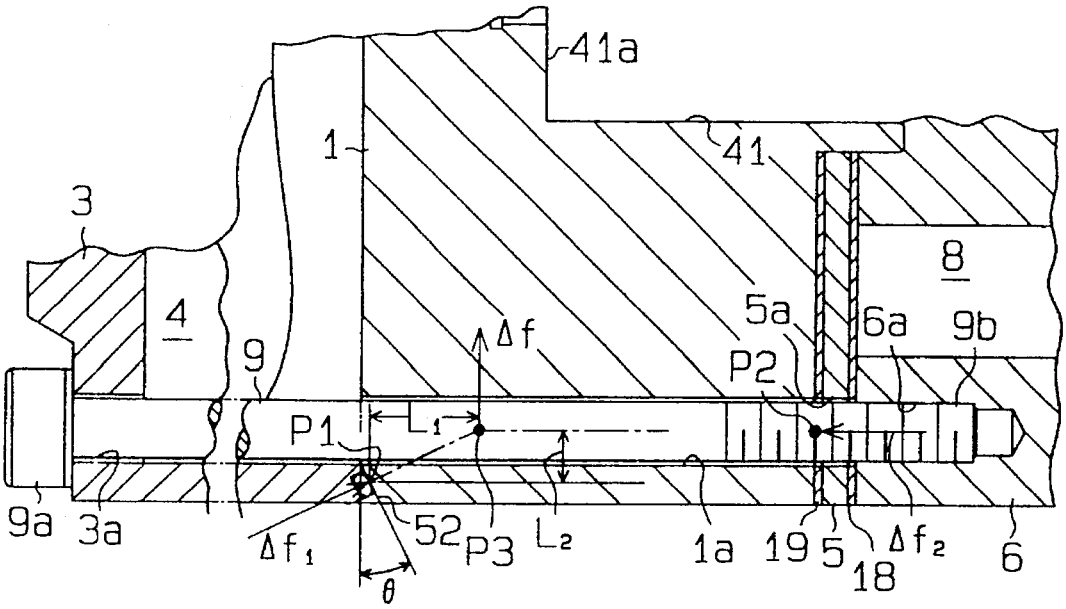
FIG. 2 is a fragmentary cross-sectional side elevation view showing a through bolt of the compressor according to the first embodiment.

As shown in FIGS. 2 and 3, each bolt 9 has a head 9*a* at its front end and a threads 9*b* at its rear or opposite end. The threads engage with screw holes 6*a* in the rear housing 6. The middle portion of each bolt 9 is loosely fitted in insertion holes 3*a* formed in the front housing 3, insertion holes 1*a* formed in the crank chamber 4 and cylinder block 1, and insertion holes 5*a* in the valve plate 5. Therefore, each through bolt 9 is located inward of the inner walls of the housing 3 and the crank chamber 4.

A pair of conical mating surfaces are formed on the cylinder block 1 and front housing 3. The juncture of the mating surfaces is represented by the line 52. The mating surfaces are inclined in such a way that the juncture is wider toward the rear of the cylinder block 1. The inclination angle θ of the line 52 with respect to a radius extending perpendicular to the drive shaft 21 is set within a range of 20 to 40 degrees.

Figure 1:
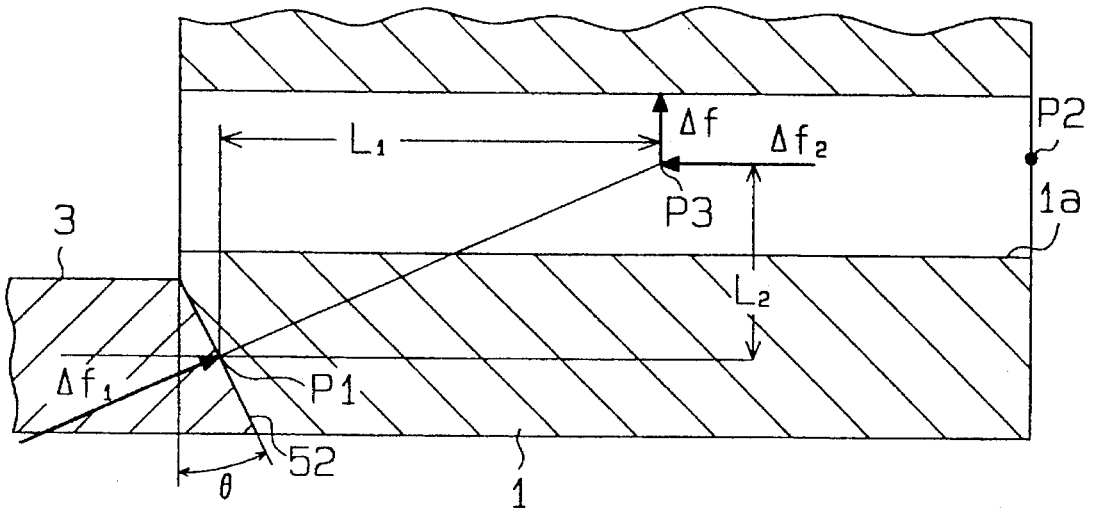
FIG. 1 is a cross-sectional view showing a part of a compressor according to a first embodiment of this invention.

A plurality of forces acting on the cylinder block 1 will now be discussed with reference to FIGS. 1 and 2. Assume that uniform surface pressure is acting on the juncture represented by the line 52, and $\Delta f_1$ is the force acting on one point P1 on one segmented surface obtained by dividing the entire juncture area represented by line 52 by minute angles $\Delta\phi$ (not shown) in the circumferential direction. Also assume that the fastening force by a plurality of through bolts 9 coincides with the resultant force of all the forces acting on the cylinder block 1 from the rear housing 6. Therefore, the resultant force can be approximated as the force acting on the cylinder block on the circle passing through the center axes of the bolts 9. Further, suppose that force $\Delta f_2$, obtained by minutely dividing that force in the circumferential direction, acts on one point P2.

Force $\Delta f$ acting inward in the radial direction acts on the intersection point of the extended lines of application of the forces $\Delta f_1$ and $\Delta f_2$, or point P3. As apparent from FIG. 1, the aforementioned forces are expressed by the following equations:

$$\Delta f_2=\Delta f \cos \theta \quad (1)$$

$$\Delta f=\Delta f_1 \sin \theta \quad (2)$$

$$L_1\Delta f=L_2\Delta f_2 \quad (3)$$

where $L_1$ in the equation (3) is the distance in the axial direction from the point of application P1 to the point of application P3, and $L_2$ in the equation (3) is the distance in the radial direction from the point of application P1 to the point of application P3.

Substituting the equations (1) and (2) into the equation (3) yields the following equation.

$$L_1\Delta f_1 \sin \theta=L_2\Delta f_1 \cos \theta$$

Rearranging the above equation yields the following equation (4).

$$L_1=L_2/\tan \theta \quad (4)$$

Using the tightening force $F_2$ in the axial direction of the through bolt 9 and the aforementioned minute segmented angle $\Delta\phi$, $\Delta f_2$ is given by the following equation:

$$\Delta f_2=(\Delta\phi/2\ \pi)F_2 \quad (5)$$

From the equations (1), (2) and (5), the following equation (6) is derived:

$$\Delta f=(\Delta\phi/2\pi)F_2 \tan \theta \quad (6)$$

It is apparent from the above that the point of application P3 of the tightening force $\Delta f$ is determined by the inclination angle $\theta$ of the juncture represented by the line 52 and the distance $L_2$, and the magnitude of the tightening force $\Delta f$ is determined by the inclination angle $\theta$ and a force $F_2$ of the bolt 9 in the axial direction. By properly setting the inclination angle $\theta$ and the distance $L_2$, therefore, the conventional bending moment acting on the cylinder block can be converted to a force on the cylinder block in the radial direction. This will suppress the deformation of the cylinder block caused during assembly.

With the compressor not running, the swash plate 25 is held at the minimum inclination angle as indicated by a broken line in FIG. 3. When the drive shaft 21 is driven in this situation, the swash plate 25 is driven by the drive plate 23 and the hinge mechanism 24. Accordingly, driven by the shoes 26, the individual pistons 12 reciprocate with the minimum stroke in their respective cylinder bores 11.

In synchronism with the rotation of the drive shaft 21, the rotary valve 42 rotates, causing the suction passage 44 to communicate with the compression chamber 13 during the suction stroke via the communication hole 46. As a result, the refrigerant gas is drawn into the compression chamber 13 from the suction chamber 7 via the suction passage 44, the outlet 45 and the communication hole 46. When the piston 12 begins the compression stroke, the communication hole 46 is closed by the outer surface of the rotary valve 42, causing the gas in the compression chamber 13 to push the discharge valve 15 open for discharge to the discharge chamber 8 from the discharge port 14.

Since the cooling load is large and the pressure of the gas drawn into the compression chamber 13 is high at the initial stage of the activation of the compressor, the sum of the pressures in the compression chambers acting on the rear end surfaces of the pistons 12 is greater than the total pressure in the crank chamber 4 acting on the front end surfaces of the pistons 12. Therefore, the inclination angle of the swash plate 25 increases and the swash plate 25 is shifted to the large-displacement position indicated by a solid line in FIG. 3 against the urging force of the spring 38. As the compressor continues running in this situation, the cooling load decreases and the suction pressure decreases. This decreases the inclination angle of the swash plate 25. Therefore, the compressor is shifted to small-displacement operation and the discharge displacement is adjusted in accordance with the cooling load.

The tapered mating surfaces of the juncture represented by line 52 are provided on the front end surface of the cylinder block 1 and the rear end surface of the front housing 3 in the above-described embodiment. The mating surfaces 52 cause the bending moment acting on the cylinder block 1 to be converted to the tightening force $\Delta f$ shown in FIG. 1. Therefore, no bending moment acts on the cylinder block 1. Consequently, the possibility for deformation of the cylinder block 1 and the possibility for deformation of the cylinder bores 11 is suppressed thus ensuring smooth reciprocation of the pistons 12. Further, deformation of the valve chamber 41 of the rotary valve 42 is suppressed, thus ensuring smooth rotation of the rotary valve 42.

In the above-described embodiment, the point of application P3 of the tightening force $\Delta f$ acting on the cylinder block 1 is set frontward of the front end surface 41*a* of the valve chamber 41 as shown in FIG. 2. Since no cavity like the valve chamber 41 is formed in that part, the part has a higher rigidity than the rear portion of the cylinder block 1 having the valve chamber 41. This arrangement better serves to inhibit the deformation of the valve chamber 41 as compared with the case where the tightening force acts on the rear portion of the cylinder block.

Figure 6:
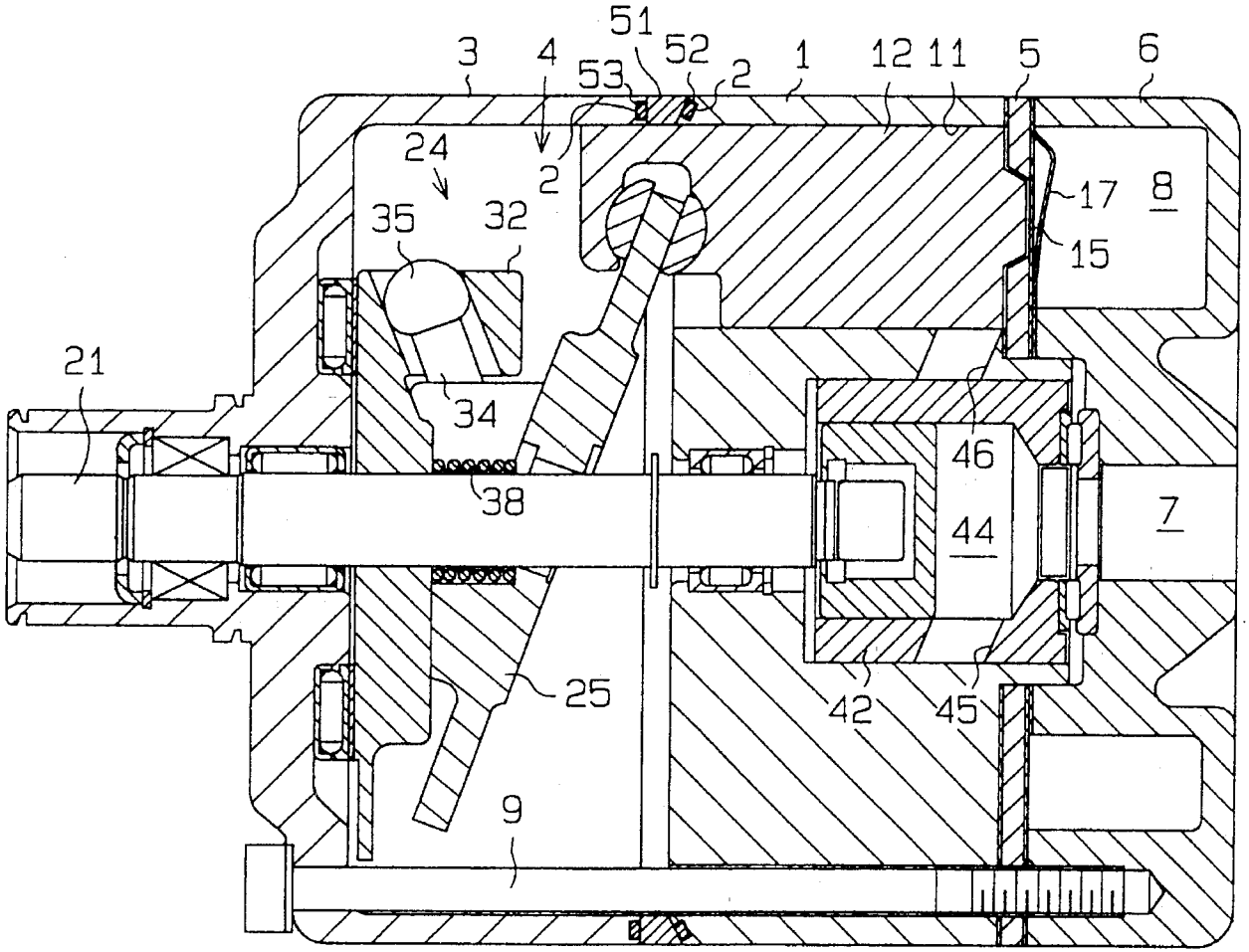
FIG. 6 is a cross-sectional side elevation view showing a compressor according to a second embodiment of this invention.

A second embodiment of this invention will now be described with reference to FIG. 6. In this embodiment, a ring 51 made of steel or the like having a high rigidity is interposed between the cylinder block 1 and the front housing 3. The tapered mating surfaces of the juncture 52 are provided on the rear surface of the ring 51, and a planar juncture 53 with the end surface of the front housing 3 is formed on the front surface of the ring 51. A seal ring 2 is provided between the conical mating surface of the ring 51 and the cooperating surface of the cylinder block 1 to seal therebetween. Likewise, a seal ring 2 is provided between the ring 51 and the surface of the front housing 3.

This embodiment has an additional advantage in that alignment of the cylinder block 1 and the front housing 3 can be performed easily by adjusting the relative assembling positions of the cylinder block 1 and the front housing 3 along the planar juncture 53.

A third embodiment of this invention will now be described with reference to FIG. 7.

In this embodiment, a valve plate 62 having a suction valve 61 is used in place of the gasket 19 of the first embodiment to selectively open or close a suction hole 63 formed in the valve plate 5. The suction chamber 7 is formed in a peripheral portion of the rear housing 6 and the discharge chamber 8 is centrally formed. Further, the rotary valve 42 and the valve chamber 41 are omitted. The other structure is the same as that of the first embodiment.

In the third embodiment, since the mating surfaces of the juncture 52 between the cylinder block 1 and the front housing 3 are tapered, the deformation of the cylinder block 1 by the tightening force of the through bolts 9 is suppressed, thus ensuring the smooth reciprocation of the pistons 12 in their respective cylinder bores 11.

A fourth embodiment of this invention as adapted for a double-headed piston type compressor will be described below with reference to FIG. 8. In this embodiment, the front housing 3 is connected to the front one of a pair of cylinder blocks 1, and the rear housing 6 is connected to a rear cylinder block 1. Both blocks 1 and both housings 3 and 6 are securely fastened by a plurality of through bolts 9. The front cylinder block, the rear cylinder block, the front housing and the rear housing constitute the casing of the compressor.

Each of the front housing 3 and the rear housing 6 has a centrally located suction chamber 7 and a peripherally located discharge chamber 8. When the swash plate 25 rotates together with the drive shaft 21, the individual double-headed pistons 12 reciprocate accordingly. As each piston reciprocates, gas is drawn into the compression chambers between the double heads of the piston 12 and the portions of the valve plate 5 facing those heads from the suction chamber 7. The compression chambers are formed at the front and rear portions of each cylinder bore 13. The drawn gas, after being compressed in each compression chamber, is discharged into the discharge chamber 8. In this embodiment, the angle of the swash plate 25 is not variable. Thus, if the number of the rotations of the drive shaft 21 is constant, the discharge displacement is kept constant.

In this embodiment, the crank chamber 4 for accommodating the swash plate 25 is formed between both cylinder blocks 1. A pair of sub-rings 51 are interposed between both blocks 1. The sub-rings 51 are connected together along a planar juncture 53. A pair of junctures 52 where the rings 51 mate with the respective blocks 1 are tapered in such a way as to be inclined with respect to the axis of the drive shaft 21. The distance between the mating surfaces 52 is greater toward the periphery of the blocks 1. The seal rings 2 are provided the mating surfaces 52 to seal between the sub-rings 51 and the respective cylinder blocks 1 and between both sub-rings 51.

In the compressor of this embodiment, the tapered mating surfaces of the juncture 52 serve to suppress the deformation of both cylinder blocks 1 caused by the tightening force of the through bolts 9. As a result, the possibility for deformation of the cylinder bores 11 is suppressed, thus ensuring the smooth reciprocation of the pistons 12. As the planar juncture 53 is also provided in the compressor of this embodiment, alignment of the cylinder blocks 1 can be easily carried out.

A fifth embodiment of this invention will now be described with reference to FIG. 9.

Figure 9:
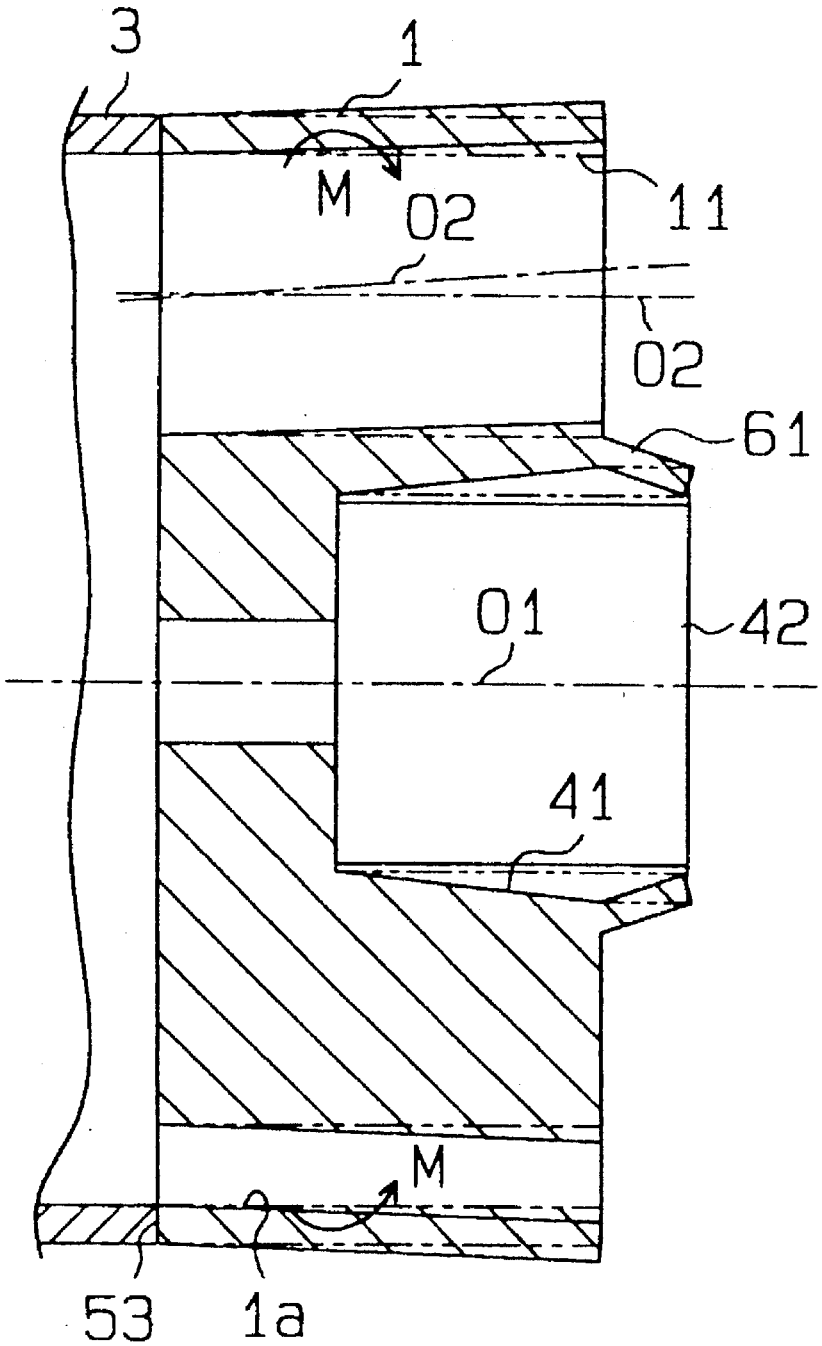
FIG. 9 is a fragmentary cross-sectional view showing a part of a compressor according to a fifth embodiment of this invention.

In this embodiment, the cylinder block 1 is pre-deformed in such a way that the distance between the center axis O1 of the cylinder block 1 and the center axis O2 of each cylinder bore 11 is greater toward the rear before the through bolts 9 are fastened as indicated by the solid line in FIG. 9. The positional offset between the axes O1 and O2 is set so as to cancel out the deformation of the cylinder block 1 caused when the compressor is assembled.

The valve chamber 41 for the rotary valve 42 is formed in the center portion of the cylinder block 1. The inner diameter of the valve chamber 41 is gradually increased toward the rear side from the front side and the inner wall of the valve chamber 41 is thus tapered as indicated by the solid line in FIG. 9. A peripheral wall 61 protrudes from the rear end of the cylinder block 1 and its interior communicates with the valve chamber 41. The inner diameter of the peripheral wall 61 is gradually decreased toward the rear side from the front side and the inner wall of the peripheral wall 61 is thus tapered in the opposite direction to that of the valve chamber 41. The tapered inner walls of the valve chamber 41 and the peripheral wall 61 are provided to cancel out the deformation of the cylinder block 1 that occurs during assembly of the compressor. Further, the cylinder block 1 and the front housing 3 are mated via the planar juncture 53.

In this embodiment, as in the prior art, the cylinder block 1 deforms due to the bending moment M produced by the tightening force of the through bolts 9. However, the cylinder block 1 is pre-formed to cancel out the deformation caused by the bending moment M. When the cylinder block 1 is fastened with the through bolts 9, therefore, the cylinder bores 11 deform to the normal state as indicated by a broken line in FIG. 9 where the axes O1 and O2 are parallel to each other. This permits the pistons 12 to smoothly reciprocate. The inner walls of the valve chamber 41 and the peripheral wall 61 deform to the normal shape as indicated by the broken line in FIG. 9 where their inner diameters are uniform. This ensures the smooth rotation of the rotary valve 42.

A sixth embodiment of this invention will now be described with reference to FIG. 10.

Figure 8:
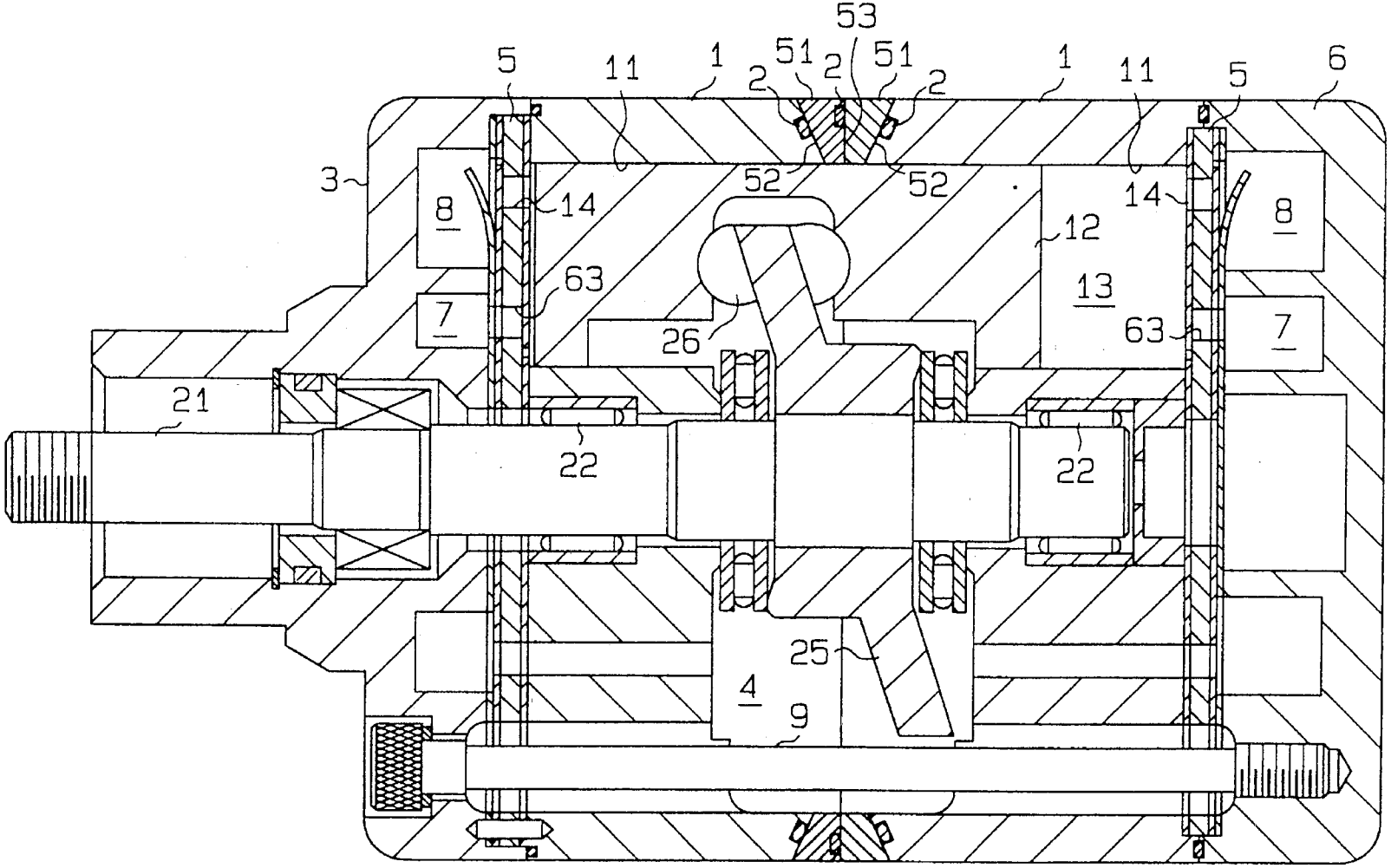
FIG. 8 is a cross-sectional side elevation view showing a compressor according to a fourth embodiment of this invention.

In the sixth embodiment, the ring 51 in the embodiment shown in FIG. 8 is omitted. Valve chambers 41 for housing a rotary valve (not shown) having approximately the same structure as the rotary valve 42 shown in FIG. 3 are provided in the center portions of both cylinder blocks 1.

Figure 10:
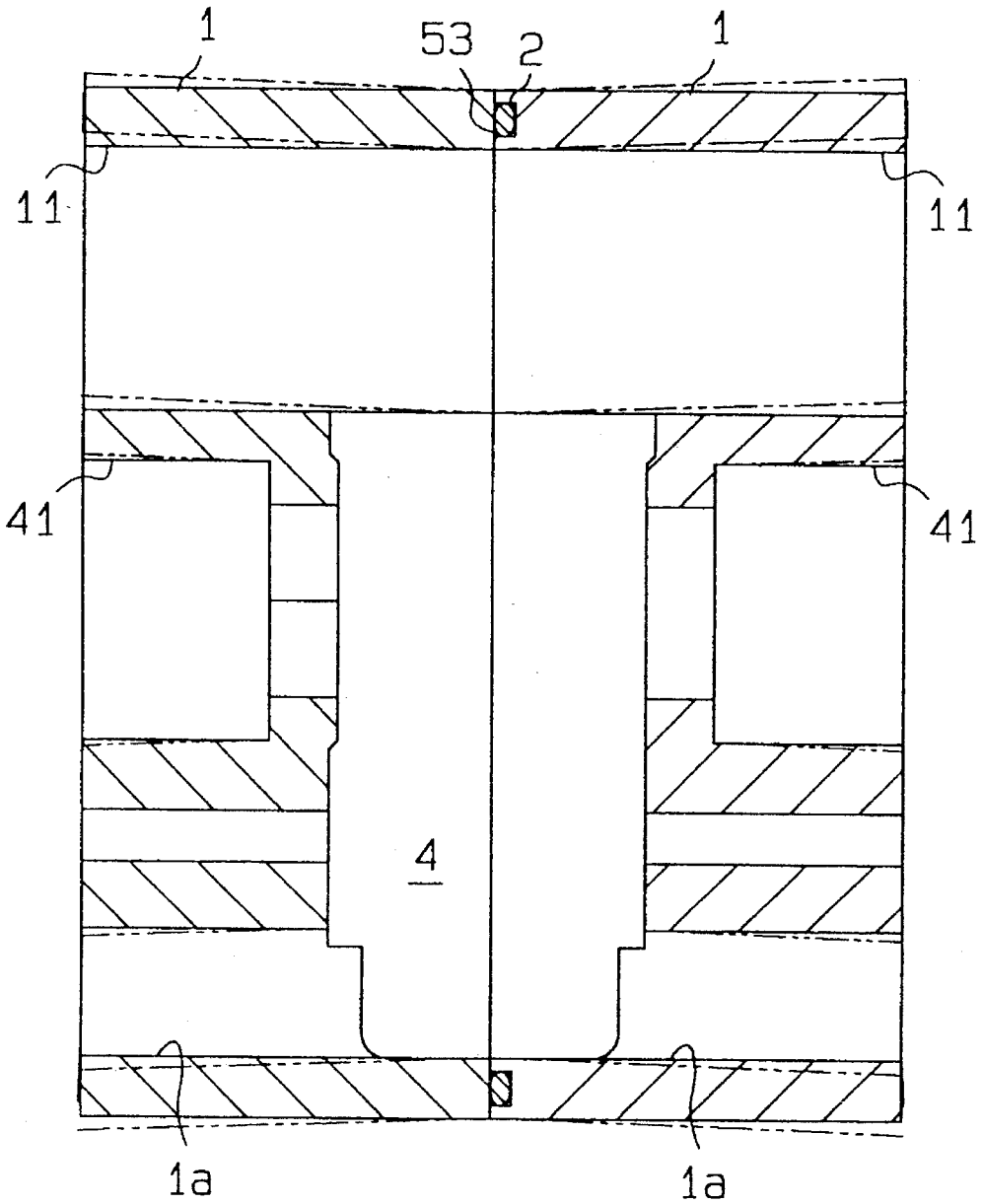
FIG. 10 is a cross-sectional view showing a part of a compressor according to a sixth embodiment of this invention.

Both cylinder blocks 1 have pre-deformed cylinder bores 11 so as to incline outward toward the rear end or the front end of both cylinder blocks 1 from the mating surfaces 53 as indicated by a broken line in FIG. 10 before the cylinder blocks 1 are tightened with the through bolts 9. The valve chambers 41 are pre-deformed so that their diameters increase toward the outside of both cylinder blocks 1 from the mating juncture 53. After fastening the cylinder blocks 1, the cylinder bores 11 and the valve chamber 41 are deformed to their normal state as indicated by a solid line in FIG. 10. In the normal state, the individual cylinder bores 11 extend parallel to the axis of the drive shaft and the inner diameter of the valve chamber 41 becomes uniformly cylindrical.

Therefore, this embodiment also can ensure the smooth reciprocation of the pistons 12 in their respective cylinder bores 11 and the smooth rotation of the rotary valve 42 in the valve chamber 41.

This invention is not limited to the above-described embodiments, but may be embodied in the following forms.

Figure 11:
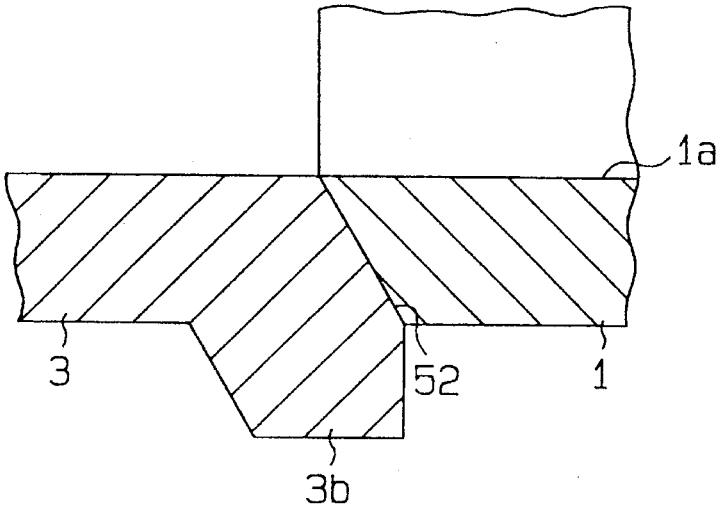
FIG. 11 is a fragmentary cross-sectional view showing a part of a compressor according to a modification of this invention.
Figure 12:
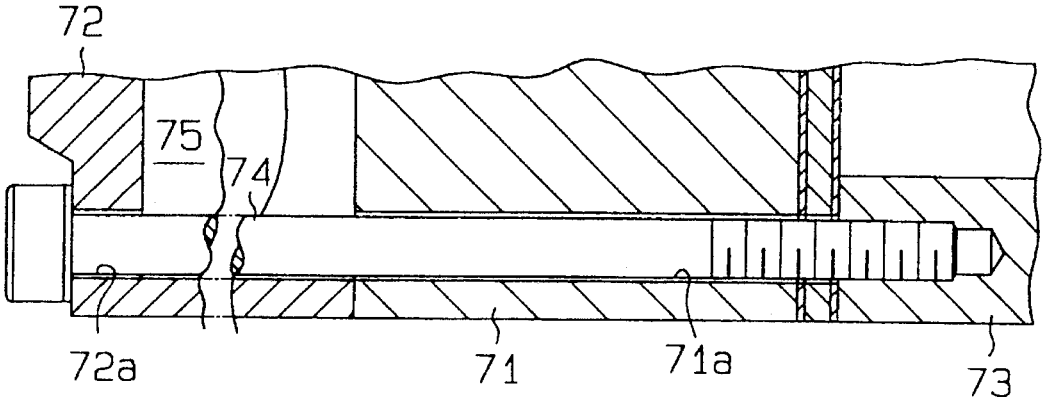
Fig. 12 (Prior Art)
FIG. 12 is a fragmentary cross-sectional view of a conventional compressor.
Figure 13:
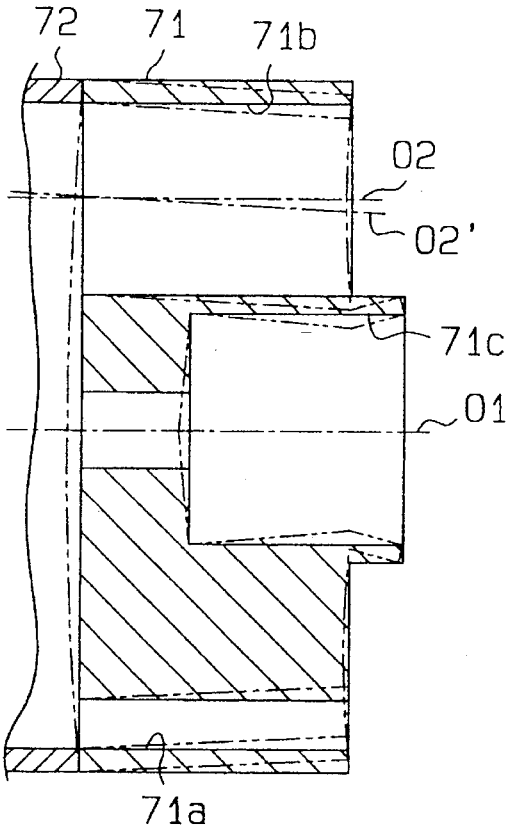
Fig. 13 (Prior Art)
FIG. 13 is a fragmentary cross-sectional view of the conventional compressor.
Figure 14:
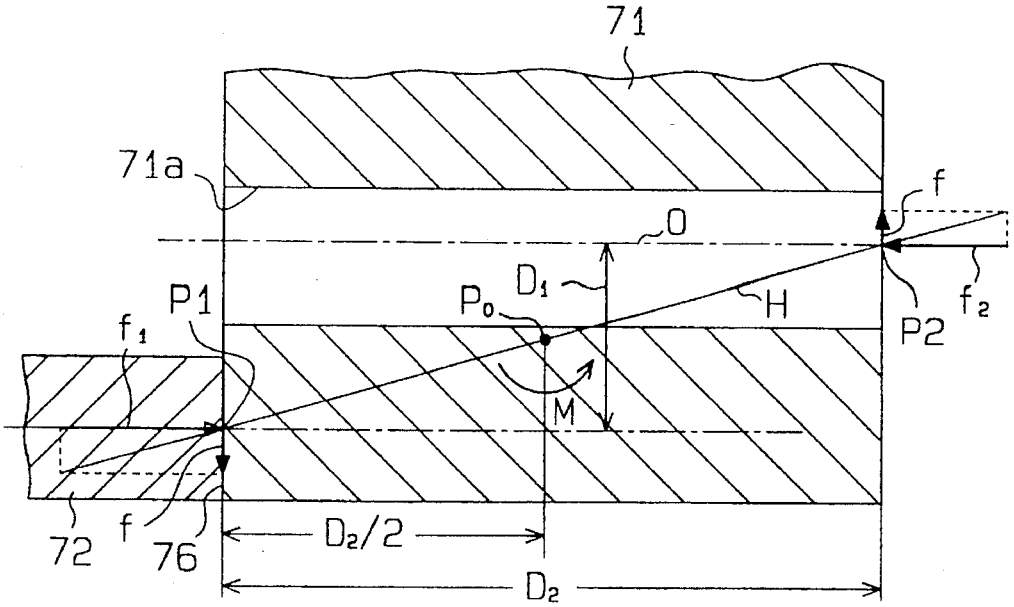
Fig. 14 (Prior Art)
FIG. 14 is a fragmentary cross-sectional view of the conventional compressor.

(1) As shown in FIG. 11, an extending portion **3*b* is formed integrally with the periphery of the front housing 3 in association with the tapered mating juncture 52. In this case, the strength of the housing 3** is enhanced.

(2) The seal ring is attached to the tapered mating surface of the cylinder block 1 instead of the tapered mating surface of the front housing 3 in the embodiment shown in FIG. 3. The seal ring 2 is attached to the tapered mating surface of the ring 51 instead of the tapered mating surface of the front housing 3 in the embodiment shown in FIG. 6. In those cases, the strength of the front housing 3 is improved.

(3) In FIG. 2, the point of application P3 of the tightening force $\Delta f$ is set to be closer to the front of the compressor than the front inner end surface 41*a* of the valve chamber 41. Even if this point of application P3 is set closer to the rear of the compressor than the front inner end surface 41*a*, only the tightening force acts on the cylinder block 1. Therefore, deformation of the cylinder block 1 is suppressed as compared with the case where a bending moment M acts on the cylinder block 1 as in the prior art.

(4) Although the suction passage 44 is provided in the rotary valve 42 in the first embodiment, a discharge passage (not shown) may be provided in addition thereto or alone.

(5) In the embodiment shown in FIG. 8, the rings 51 may be integrated. In this case, the number of parts is reduced, thus simplifying the manufacture of the compressor and reducing the manufacturing cost.

Figure 7:
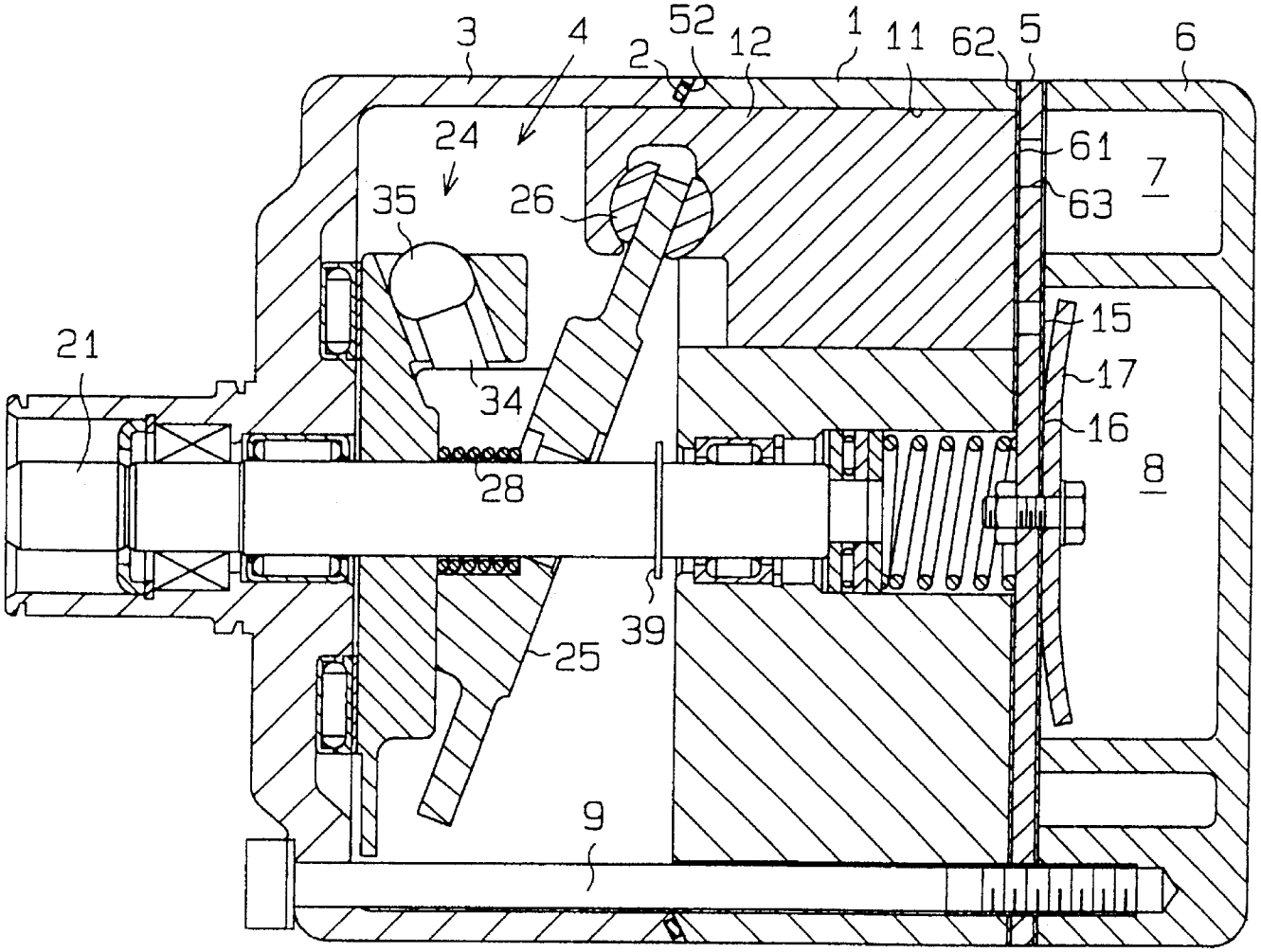
FIG. 7 is a cross-sectional side elevation view showing a compressor according to a third embodiment of this invention.

(6) In the embodiments shown in FIGS. 9 and 10, the valve structures as shown in FIGS. 7 and 8 may be used in place of the rotary valve. In this case, the valve chamber 41 can be omitted and only the cylinder bores 11 should be pre-deformed. This results in a cost reduction.

Therefore, the present examples and embodiments are to be considered as illustrative and not restrictive and the invention is not to be limited to the details given herein, but may be modified within the scope of the appended claims.

What is claimed is:

1. A piston type compressor for sucking and compressing gas by a plurality of pistons reciprocated in a casing in accordance with the rotation of a drive shaft supported in the casing, the compressor comprising:

a plurality of casing components disposed along an axis of the drive shaft and mated with one another for forming said casing; and means for suppressing a bending moment generated in a specific one of the casing components when the casing components are compressed in a direction parallel to the axis of the drive shaft.

2. A compressor according to claim 1, wherein said suppressing means including:

mating surfaces provided on the respective casing components to face each other, wherein said mating surfaces are inclined with respect to the axis of the drive shaft; and fastening means for compressing the casing components along a direction parallel to the axis of the drive shaft, wherein said suppressing means generates a tightening force directed inward with respect to the casing according to the inclination of the mating surfaces.

3. A compressor according to claim 2, wherein said casing comprising:

a cylinder block having an outer peripheral portion and a plurality of cylinder bores where the gas is compressed;

a front housing mated with the cylinder block and having an outer peripheral portion; and a rear housing mated with the cylinder block and having an outer peripheral portion;

wherein said fastening means includes a plurality of bolts penetrating the cylinder block and the front housing at the outer peripheral portions thereof to hold the front housing and the rear housing to the cylinder block.

4. A compressor according to claim 3 further comprising:

a suction chamber provided in the rear housing for sucking the gas from outside of the compressor;

a discharge chamber provided in the rear housing for accommodating the gas compressed in the cylinder bores;

said cylinder block and front housing each having holes for rotatably supporting the drive shaft;

said cylinder bores being arranged around the drive shaft;

a rotary valve synchronously rotatable with the drive shaft;

a valve chamber provided with the cylinder block for accommodating the rotary valve, said valve chamber communicating with the hole of the cylinder block; and a passage provided with the rotary valve for supplying gas in the suction chamber to the cylinder bores.

5. A compressor according to claim 4 wherein said tightening force is generated at a location that is frontward of the valve chamber.

6. A compressor according to claim 2 further comprising a ring interposed between the cylinder block and the front housing, said ring having mating surfaces, each mating with corresponding mating surfaces of the cylinder block and the front housing, and wherein said mating surfaces of the ring and the cylinder block are inclined with respect to the axis of the drive shaft.

7. A compressor according to claim 3 further comprising seals disposed at the mating surfaces and wherein said bolts are located inward of the seals.

8. A compressor according to claim 2 wherein each piston includes a double-headed piston having heads at a front end and a rear end of each piston, wherein said casing includes:

a front cylinder block and a rear cylinder block each having a cylinder bore for accommodating a double-headed piston;

a ring interposed between the front and rear cylinder blocks, said front and rear cylinder blocks being mated with each other with the ring, said front cylinder block and rear cylinder block and ring each having a mating surface inclined with respect to the axis of the drive shaft and said ring having a pair of opposed mating surfaces, each of which is inclined with respect to the axis of the drive shaft; and a front housing mated with the front cylinder block; and a rear housing mated with the rear cylinder block; wherein said fastening means includes a plurality of bolts penetrating the front and rear cylinder block at the outer peripheral portions thereof and holding the front housing and the rear housing to the front and the rear cylinder blocks.

9. A compressor according to claim 8 further comprising:

suction chambers provided with the front housing and the rear housing for sucking the gas from outside the compressor;

discharge chambers provided with the front housing and the rear housing for accommodating the gas compressed in the cylinder bores;

said front and rear cylinder blocks and the front housing having holes for rotatably supporting the drive shaft; and said cylinder bores being arranged around the drive shaft.

10. A compressor according to claim 8 further comprising seals disposed at the mating surfaces and wherein said bolts are located inward of the seals.

11. A compressor according to claim 10, wherein said ring includes a pair of sub-rings mated with the front cylinder block and the rear cylinder block, respectively, said sub-rings being mated with each other with seals.

12. A compressor according to claim 1, wherein said casing includes:

a cylinder block having a plurality of cylinder bores where gas is compressed;

a front housing mated with the cylinder block; and a rear housing mated with the cylinder block;

wherein said suppressing means includes a plurality of bolts penetrating the cylinder block, the front housing and the rear housing, said bolts serving to fasten the front housing and the rear housing to the cylinder block along a direction parallel to the axis of the drive shaft, and wherein said cylinder block is pre-deformed for negating deformation of the cylinder block due to a bending moment generated when the front housing and the rear housing are fastened to the cylinder block by the bolts.

13. A compressor according to claim 12, wherein said pre-deformation of the cylinder block is accomplished by inclining axes of the cylinder bores outward of the compressor from front side toward rear side of the cylinder bores.

14. A compressor according to claim 1, wherein each piston includes a double-headed piston having a head at a front end and a rear end of each piston, wherein said casing includes:

a front cylinder block and a rear cylinder block each having a cylinder bore for accommodating a double-headed piston;

a front housing mated with the front cylinder block; and a rear housing mated with the rear cylinder block; and wherein said suppressing means includes a plurality of bolts fastening the front housing and the rear housing to the front and the rear cylinder blocks along a direction parallel to the axis of the drive shaft, and wherein said front and rear cylinder blocks are pre-deformed for negating the deformation of cylinder blocks due to a bending moment generated when the bolts are tightened.

15. A piston type compressor including a cylinder block having a plurality of cylinder bores, a front housing mated with a front end of the cylinder block and a rear housing mated with a rear end of the cylinder block, wherein a plurality of pistons reciprocate in the respective cylinder bores in accordance with rotation of a drive shaft supported by holes in the front housing and the cylinder block, said pistons being operable to suck gas from a suction chamber in the rear housing into the cylinder bores, compress the gas in the cylinder bores and then discharge the gas into a discharge chamber in the rear housing, said compressor comprising:

mating surfaces provided on the cylinder block and the front housing facing each other, said mating surfaces being inclined with respect to an axis of the drive shaft; and fastening means for fastening the front housing and the rear housing with the cylinder block along a direction parallel to the axis of the drive shaft, wherein said fastening means generates a tightening force directed inward with respect to the cylinder block according to the inclination of the mating surfaces.

16. A compressor according to claim 15, wherein said fastening means includes a plurality of bolts penetrating the cylinder block at outer peripheral portions of the cylinder block and the front housing for holding the front housing and the rear housing to the cylinder block.

17. A compressor according to claim 15 further comprising:

a rotary valve synchronously rotatable with the drive shaft;

a valve chamber provided with the cylinder block for accommodating the rotary valve; and a passage provided with the rotary valve for supplying the gas in the suction chamber to the cylinder bores.

18. A compressor according to claim 15 wherein said tightening force is generated in the cylinder block frontward of the valve chamber.

19. A compressor according to claim 15 further comprising a ring mated with the front housing, said ring having a mating surface mated to the mating surface of the cylinder block, said mating surfaces of the ring and the cylinder block being inclined with respect to the axis of the drive shaft.

20. A piston type compressor including a front cylinder block and a rear cylinder block mated with each other, said blocks having a plurality of cylinder bores, a front housing mated with the front cylinder block and a rear housing mated with the rear cylinder block, wherein a plurality of double-headed pistons reciprocate in the respective cylinder bores in accordance with rotation of a drive shaft supported by the front housing, rear housing, front cylinder block and rear cylinder block, said pistons being operable to suck gas from suction chambers in the front housing and rear housing into the associated cylinder bores, compress the gas, and then discharge the gas into discharge chambers in the front housing and the rear housing, said compressor comprising:

mating surfaces provided on the front and rear cylinder block facing each other, said mating surfaces being inclined with respect to an axis of the drive shaft; and fastening means for fastening the front housing, rear housing, front cylinder block and rear cylinder block along a direction parallel to the axis of the drive shaft such that the front and rear cylinder blocks are mated with each other, the front housing is mated with the front cylinder block and the rear housing is mated with the rear cylinder block and such that said fastening means generates tightening forces directed inward with respect to the front and rear cylinder blocks according to the inclination of the mating surfaces.

21. A compressor according to claim 20, wherein said fastening means includes a plurality of bolts penetrating the front and rear cylinder blocks at the outer peripheral portions thereof and holding the front housing and the rear housing to the front and the rear cylinder blocks.

22. A compressor according to claim 21 further comprising seals disposed at the mating surfaces and wherein said bolts are located inward of the seals.

23. A compressor according to claim 20 further comprising a ring interposed between the front and rear cylinder blocks, said front and rear cylinder blocks being mated with each other with the ring, said front cylinder block, rear cylinder block and ring each having mating surfaces inclined with respect to the axis of the drive shaft.

24. A compressor according to claim 23, wherein said ring includes a pair of sub-rings mated with the front cylinder block and the rear cylinder block, respectively, said sub-rings being mated with each other with seals.

* * * * *